US005751097A

United States Patent [19]

Mandelman et al.

[11] Patent Number: 5,751,097

[45] Date of Patent: May 12, 1998

[54] LATERAL FIELD EMISSION DEVICES FOR DISPLAY ELEMENTS AND METHODS OF FABRICATION

[75] Inventors: Jack Allan Mandelman, Stormville, N.Y.; Micheal David Potter, Grand Isle, Vt.

[73] Assignee: International Business Machines Corporation, Armonk, N.Y.

[21] Appl. No.: 789,175

[22] Filed: Jan. 24, 1997

Related U.S. Application Data

[62] Division of Ser. No. 641,252, Apr. 30, 1996, which is a continuation of Ser. No. 331,307, Oct. 28, 1994, Pat. No. 5,629,580.

[51] Int. Cl.[6] ..... H01J 1/16; B05D 5/12

[52] U.S. Cl. ..... 313/310; 313/309; 313/336; 313/351; 427/64; 427/165; 427/108; 427/287; 427/164; 427/266

[58] Field of Search ..... 427/64, 165, 108, 427/287, 266; 313/310, 309, 336, 351

[56] References Cited

U.S. PATENT DOCUMENTS

| | | | |
|---|---|---|---|
| 4,281,890 | 8/1981 | Kane | 313/309 |
| 4,827,177 | 5/1989 | Lee et al. | 313/306 |
| 5,015,912 | 5/1991 | Spindt et al. | 313/309 |
| 5,066,883 | 11/1991 | Yoshioka et al. | 313/309 |
| 5,144,191 | 9/1992 | Jones et al. | 313/308 |
| 5,214,347 | 5/1993 | Gray | 313/355 |
| 5,233,263 | 8/1993 | Cronin et al. | 313/309 |
| 5,308,439 | 5/1994 | Cronin et al. | 156/656 |
| 5,341,063 | 8/1994 | Komar et al. | 313/309 |

*Primary Examiner*—Janyce Bell
*Attorney, Agent, or Firm*—Heslin & Rothenberg, P.C.

[57] ABSTRACT

Lateral field emission devices ("FEDs") for display elements and methods of fabrication are set forth. The FED includes a thin-film emitter oriented parallel to, and disposed above, a substrate. The FED further includes a columnar shaped anode having a first lateral surface. A phosphor layer is disposed adjacent to the first lateral surface. Specifically, the anode is oriented such that the lateral surface and adjacent phosphor layer are perpendicular to the substrate. The emitter has a tip which is spaced less than the mean free distance of an electron in air from the phosphor layer. Operationally, when a voltage potential is applied between said anode and said emitter, electrons are emitted from the tip of the emitter into the phosphor layer causing the phosphor layer to emit electromagnetic energy. Further specific details of the field emission device, fabrication method, method of operation, and associated display are set forth.

11 Claims, 4 Drawing Sheets

LATERAL FIELD EMISSION DEVICES FOR DISPLAY ELEMENTS AND METHODS OF FABRICATION

This application is a division of application Ser. No. 08/641,252 filed Apr. 30, 1996 which application is now pending; and which comprises a continuation of application Ser. No. 078/331,307 filed Oct. 28, 1994, which is now U.S. Pat. No. 5,629,580.

TECHNICAL FIELD

This invention relates in general to integrated microelectronic devices having a field emission cathode structure. More particularly, the invention relates to lateral field emission devices for use as display elements.

BACKGROUND OF THE INVENTION

Field emission devices ("FEDs") or micro-vacuum tubes have gained recent popularity as alternatives to conventional semiconductor silicon devices. Typical advantages associated with FEDs are much faster switching, temperature and radiation insensitivity, and easy construction. Applications range from discrete active devices to high density static random access memories, displays, radiation hardened military applications and temperature insensitive space technologies, etc.

Historically, the literature on field emission devices principally focused on process problems associated with producing the sharpest vertical emitter tip (e.g., with photolithography), and controlling cathode to anode and cathode to gate distances by achieving self-alignment between these elements.

Recently, lateral field emission devices have emerged as an alternative to traditional vertical emitter devices. In U.S. Pat. No. 5,233,263 entitled "Lateral Field Emission Devices," issued Aug. 3, 1993, and U.S. Pat. No. 5,308,439 entitled "Lateral Field Emission Devices And Methods of Fabrication," issued May 3, 1994, lateral field emission devices employing a horizontal thin-film emitter are described. The sharp radius of curvature around the edge of the thin-film emitter produces the high intensity electric field necessary to cause the emission of electrons. In specific regard to the details of the devices described, the emitter tip is always separated from an anode by a distance of approximately 1 micron. In one embodiment, a light emitting FED is created by replacing the anode with a conductive-type phosphor. Electrons are thus transferred into the phosphor causing an emission of light.

These devices have several limitations when used as display elements. The large distance between the emitter tip and the anode results in a large voltage potential being required to excite emission of electrons from the emitter tip towards the anode. Due to the high voltage potential, careful control of the environment between the emitter and the anode is needed so as to avoid degradation of the emitter. For example, the device may be disposed in an evacuated atmosphere or in an inert gas. In regard to further device limitations, when the anode is replaced with a phosphor, ballistic steering effects due to electric fields deflect emitted electrons downward towards a metal extraction anode disposed below the phosphor. Due to the inherent resistance of conductive-type phosphors, coupled with the relatively large volume of phosphor electrons must travel through to reach the extraction anode, even higher voltage potentials are required, which hinders extraction of electrons from the phosphor.

In U.S. Pat. No. 5,144,191 entitled "Horizontal Microelectronic Field Emission Devices," issued Sep. 1, 1992, another lateral field emission device is described. Again, the distance between the emitter tip and anode is on the order of 1 micron, thereby having the aforementioned problems associated therewith (i.e., large operating voltage, emitter degradation, and requirement of a controlled ambient environment). In one embodiment, the anode is replaced with a conductive-type phosphor for creating a light emitting field emission device. This embodiment suffers from further problems. The phosphor anode (i.e., composed entirely of a phosphor) is electrically resistive, making it less efficient in attracting electrons theretowards. Furthermore, the increased resistivity of the phosphor anode hinders the efficient extraction of electrons therefrom. Taken together, these problems decrease the efficiency of the device, and increase the voltages necessary for operation.

In summary, high operating voltages limit the usefulness of FEDs in low voltage applications such as portable computers. Moreover, a requirement that the FED be disposed in a vacuum (or other inert gas environment) adds to the complexity and fabrication costs of the device. The structure and methods of fabrication of the present invention contain solutions to the aforementioned problems.

DISCLOSURE OF THE INVENTION

Briefly described, the present invention comprises, in a first aspect, a field emission device ("FED") for emitting electromagnetic energy. The FED includes a substrate having a main surface, and an anode disposed thereabove. The anode includes a first surface which is disposed adjacent to a phosphor layer. The FED further comprises an emitter disposed in spaced opposing relation to the first surface of the anode. The emitter has a tip that is pointed towards, and spaced less than the mean free path distance of an electron in air away from, the phosphor layer. Operationally, a voltage potential between the anode and the emitter causes electrons to be emitted from the tip of the emitter into the phosphor layer. This causes the phosphor layer to emit electromagnetic energy.

As an enhancement, the phosphor layer may comprise an insulating-type phosphor layer. The tip of the emitter may then physically contact the phosphor layer such that a voltage potential between the emitter and anode causes electrons to be directly injected into the insulating-type phosphor layer.

In other aspects described herein, the present invention includes methods for forming FEDs which are capable of emitting electromagnetic energy, and methods for producing electromagnetic energy using FEDs. Further, a display using the light-emitting FEDs of the present invention is disclosed.

The present invention comprises the formation of an advanced FED capable of emitting electromagnetic energy. Due to the extreme closeness, or even direct contact, of the emitter to the phosphor layer in an FED in accordance with the present invention, operating voltages are substantially lower than in previous devices. Moreover, the provisioning of a large anode behind the phosphor layer facilitates improved extraction of electrons therefrom. The anode's position behind the phosphor layer, perpendicular to the emitter, also eliminates ballistic steering problems. Furthermore, techniques described herein allow the creation of a FED capable of operation in ambient air environments. All of these features and advantages translate into an advanced FED, and associated display, capable of emitting electromagnetic energy.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may best be understood by reference to the following detailed description taken in conjunction with the accompanying drawings in which:

BEST MODE FOR CARRYING OUT THE INVENTION

Reference now should be made to the drawings in which the same reference numbers are used throughout the different figures to designate the same or similar components.

Fabrication methods in accordance with the present invention are described below in detail with reference to FIGS. 1–8. Each processing step described herein may be performed by standard chip or wafer level processing as will be apparent to those skilled in the semiconductor fabrication art.

Figure 1:
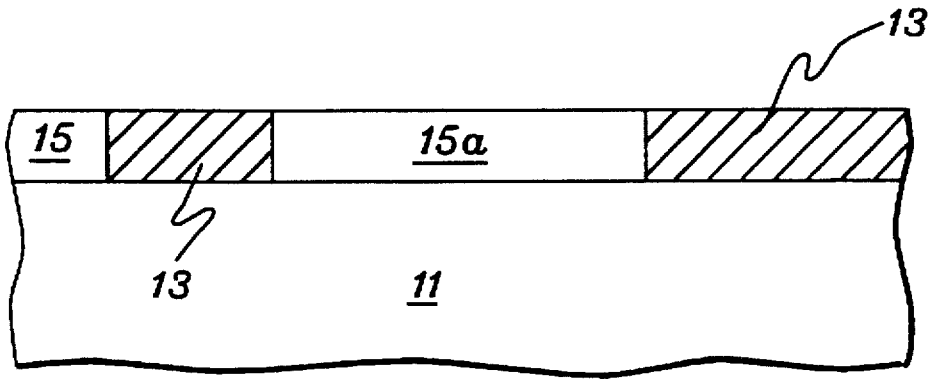
FIG. 1 is a cross-sectional view of a microelectronic assembly after a first step in one embodiment of a fabrication process of a FED, pursuant to an embodiment of the present invention.

Referring to FIG. 1, substrate 11 can comprise any glass, metal, ceramic, etc., capable of withstanding the elevated temperatures (e.g., 450° C.) typically encountered during the device fabrication processes described below. Fabrication begins with the formation of a first metallization layer 13 on substrate 11 using standard damascene processing. By way of example, insulating layer 15*a* comprising an oxide, is deposited on substrate 11. Grooves for metallization are next patterned and etched within the insulating layer. A blanket chemical vapor deposition of a conductor, such as, for example, tungsten, fills the etched grooves to form first metallization layer 13. The assembly is then planarized so that the tungsten resides only in the patterned oxide grooves.

Figure 2:
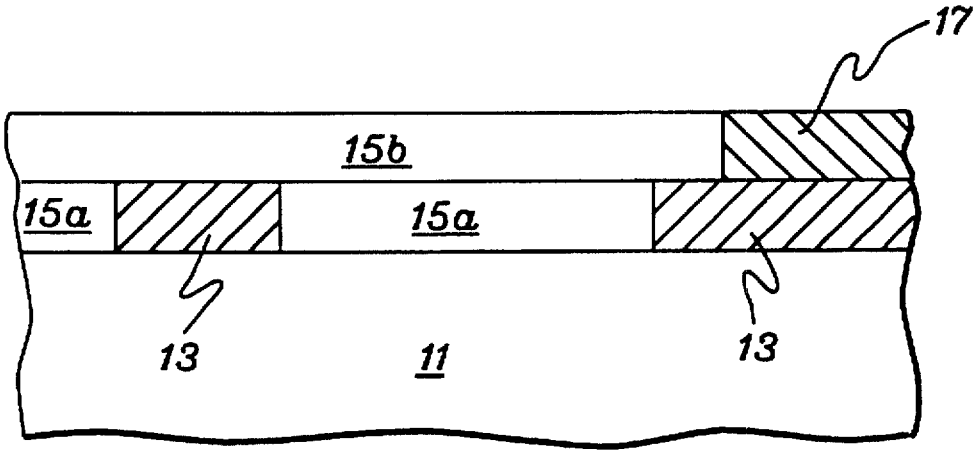
FIG. 2 is a cross-sectional view of the assembly of FIG. 1 subsequent to the formation of an anode stud in conformance with one embodiment of the present invention.

FIG. 2 illustrates the results of further processing in which stud 17 is formed within insulating layer 15*b* above first metallization layer 13. Again, conventional mask and etch procedures are used throughout the fabrication process unless stated otherwise. Stud 17 is located so as to later become a base contact for an anode (not yet formed). Thus, electrical connectivity to the anode is facilitated through the first metallization layer which is in direct electrical and mechanical contact with the stud. In an alternate embodiment, the stud may in fact be omitted, however, this may restrict the usefulness of the first metallization layer as a wiring level because large anode contact areas must then be reserved within the first metallization layer.

Figure 3:
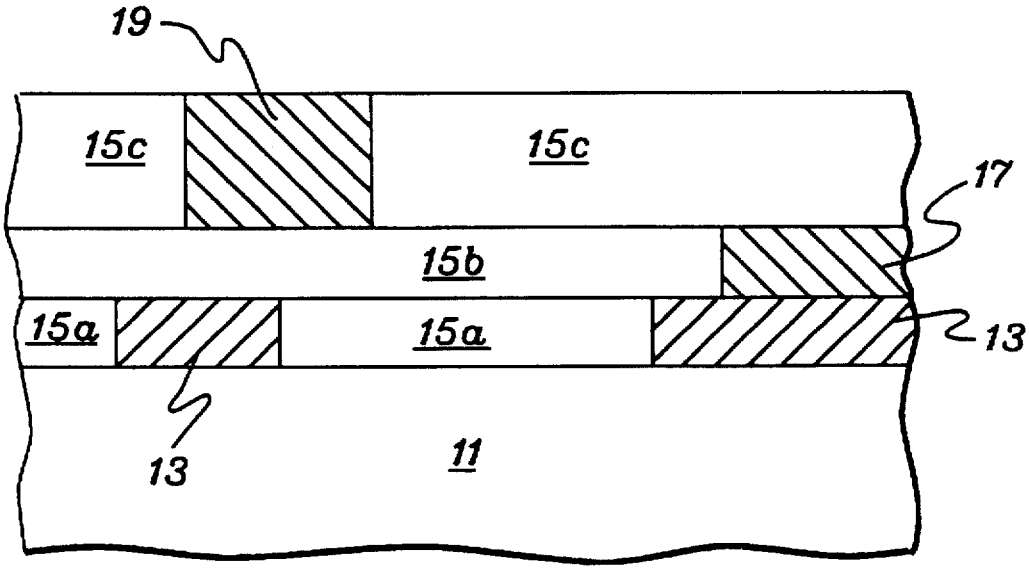
FIG. 3 is a cross-sectional view of the assembly of FIG. 2 after formation of a second metallization layer pursuant to an embodiment of the present invention.
Figure 4:
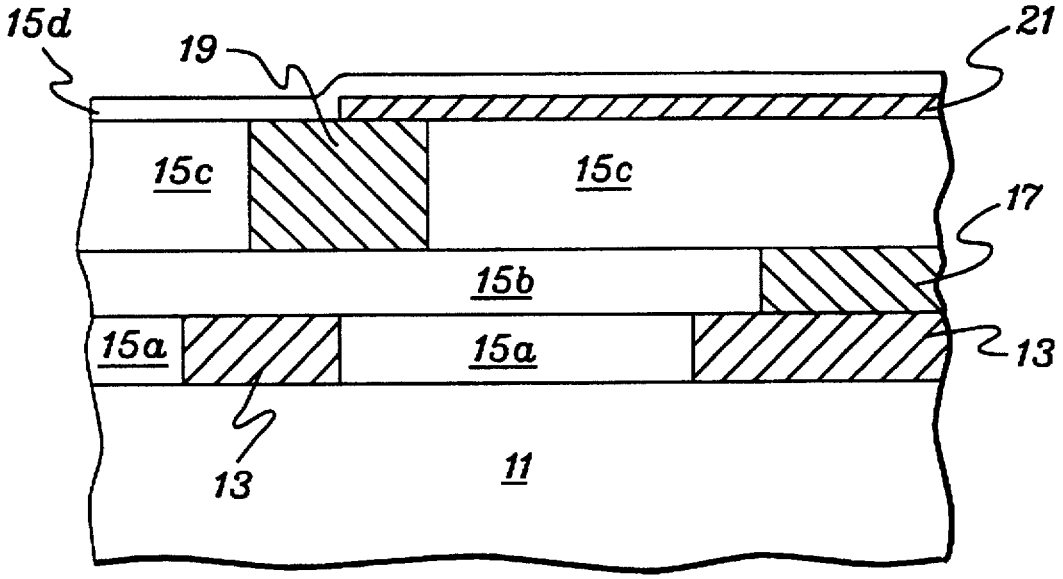
FIG. 4 is a cross-sectional view of the assembly of FIG. 3 subsequent to the formation of an emitter electrode in accordance with one embodiment of the present invention.

In further process steps, second metallization layer 19 is formed within insulating layer 15*c* (FIG. 3). The second metallization layer functions both as a wiring level and as a supporting structure for an emitter to be later formed.

Emitter 21 (FIG. 4) is next deposited and formed in electrical contact with the second metallization layer. The emitter is fabricated to have a substantially planar shape using standard thin-film techniques. For example, a very thin (e.g., several hundred angstrom thick) layer of film or metal is defined by physical deposition techniques followed by masking and etching away of the metal at all undesired locations. As is well known in the art, masking (with, for example, photoresist) is accomplished over that portion of the metal that is not to be removed while maintaining exposed the unwanted portion. The exposed portion is removed by subjecting the multi-layer structure to a metal etching process. There are several different etch processes available to those skilled in the art. As a general note, the present invention is not limited by the particular masking and etching approaches used at any of the fabrication stages discussed herein. After emitter formation is complete, thin insulation layer 15*d* is deposited over the emitter, protecting it.

The emitter may be composed of, for example, tungsten or titanium nitride; although more advanced materials with certain desirable characteristics may be used. In this regard, an important characteristic of the material used to form a FED emitter is the work-function. As is known in the art, the work-function of an emitter in a FED is the propensity of an electron to leave the emitter towards the anode. The lower the work-function, the easier it is to facilitate the departure of an electron. Advanced materials such as, for example, n-type doped diamond can have a work-function near zero and are highly desirable in FED emitter applications. Advantageously, the lower the work function, the less voltage potential required between the emitter and anode to operate the FED device.

Figure 5:
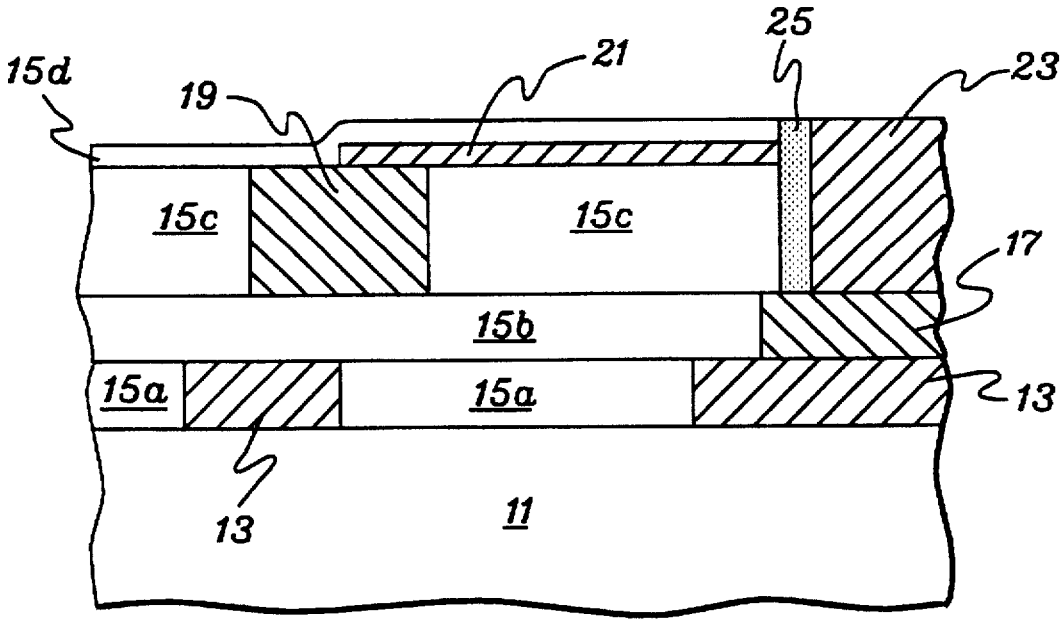
FIG. 5 is a cross-sectional view of the assembly of FIG. 4 after formation of an anode and a phosphor layer, completing fabrication of an embodiment of the present invention.

As shown in FIG. 5, subsequent to the formation of emitter 21, a hole (shown containing anode 23 and phosphor layer 25) is etched through insulating layer 15*d*, emitter 21 and insulating layer 15*c* down to buried anode stud 17. This etch is performed through emitter 21, which produces an emitter tip automatically aligned with the anode opening and hence the later formed anode. Phosphor layer 25 is then deposited on the vertical side walls of the hole by standard processes. As a typical example, a phosphor can be deposited within the anode hole by a CVD process. A reactive ion etching ("RIE"), or equivalent process, is then used to clean the phosphor from the bottom of the hole (to expose anode stud 17). This is necessary since the anode must electrically contact stud 17. Next, metal comprising anode 23 is deposited within the hole so as to fill it. Thus, a columnar shaped anode is formed with a phosphor layer surrounding its lateral surface. In one embodiment, the anode is cylindrical. A cylinder, as opposed to other columnar shapes, has only one lateral surface which has a circular cross-section.

In a subsequent step, any excess metal may be removed using a standard etch, a polishing technique, or any other suitable processing procedure. Lastly, a final passivation layer may be added if required.

The final structure of the embodiment shown contains emitter 21 being in direct contact with phosphor layer 25 which is in direct contact with anode 23. Because emitter 19 is a thin-film metallization layer, the radius of curvature across the tip of the emitter is small enough to create the high electric field necessary for the operation of the FED. As a general note, due to the direct contact of the emitter to the phosphor layer, insulating-type phosphors are required, for example, $Z_nS_iO_4:M_n$. Operationally, when a voltage potential of sufficient magnitude is applied between the emitter and anode, electrons are emitted from the emitter tip and directly injected into the phosphor layer, towards the anode. The phosphor thus glows, emitting light. Alternatively, the phosphor may be composed of a material that emits other types of electromagnetic energy such as infrared radiation, ultra-violet, etc.

Advantageously, the close orientation (i.e., direct contact) of emitter and anode to the phosphor layer allows a much lower voltage potential to be employed in energizing electromagnetic emissions of the phosphor. Furthermore, because the anode is directly behind the phosphor layer, and directly opposite the emitter tip, electrons travel horizontally through the phosphor undisturbed by ballistic steering.

Figure 6:
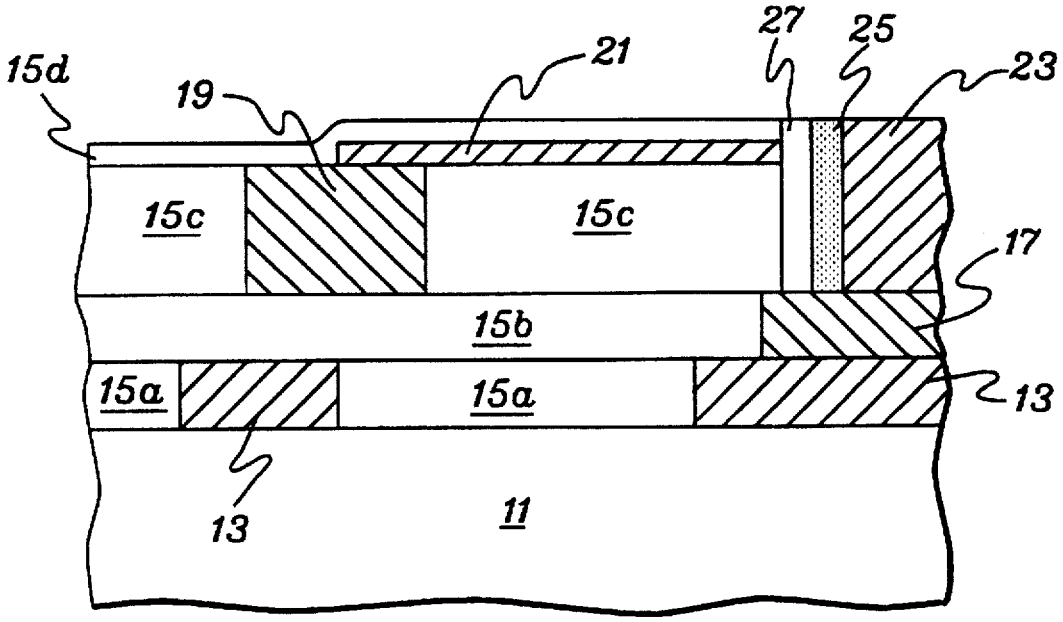
FIG. 6 is a cross-sectional view of the assembly of FIG. 4 subsequent to the formation of a sacrificial insulating layer, anode, and phosphor layer according to an alternate embodiment of the present invention.
Figure 7:
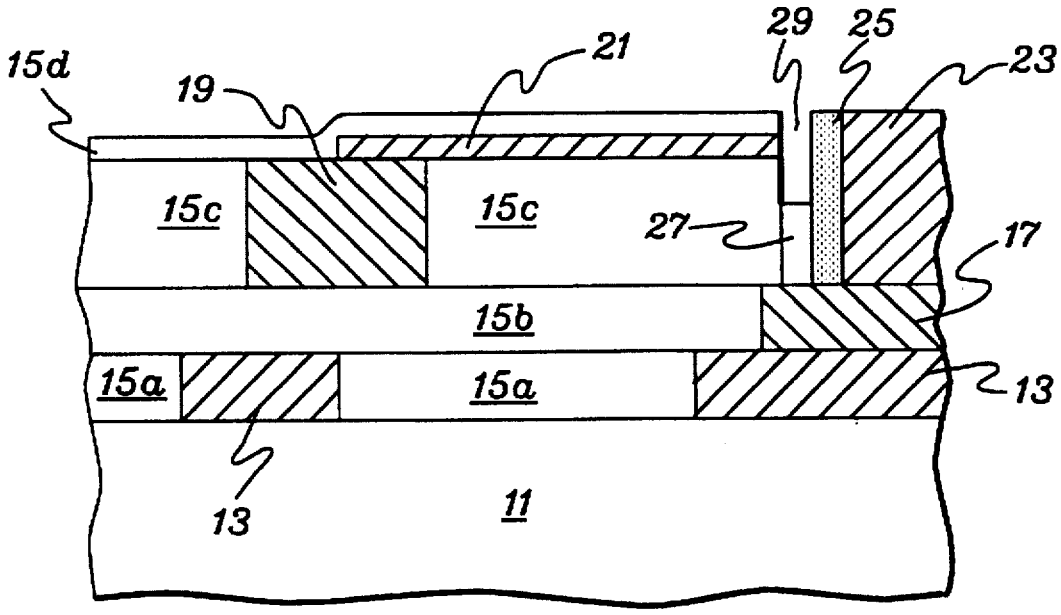
FIG. 7 is a cross-sectional view of the assembly of FIG. 6 after completion of formation pursuant to one embodiment of the present invention.

Alternative embodiments of the present invention in which conductive-type phosphors are employed (for example, zinc oxide—$Z_nO$) are shown in FIGS. 6 and 7. Referring to FIG. 6, the FED is very similar to the direct injection FED of FIG. 5, however, sacrificial insulating layer 27 is disposed between emitter 21 and phosphor layer 25. Processing to create this structure remains similar to that as previously described up through the formation of the hole for the anode. Thereafter, sacrificial layer 27 is deposited on the side walls of the hole. This layer may comprise, for example, paralene or silicone dioxide ($SiO_2$). As a typical processing example, sacrificial insulating layer 27 is deposited on the hole side walls by deposition within the anode hole followed by RIE or equivalent processing to clean the bottom of the hole and to expose anode stud 17.

Processing then continues in a manner similar to the "direct injection" previous embodiments (FIG. 5) by depositing phosphor layer 25 on the vertical side walls of the hole and filling the hole with metal to form anode 23. Again, excess metal may be removed by an etch, polishing technique, or any other suitable processing procedure. During operation, electrons emitted from emitter 21 will pass through sacrificial insulating layer 27, through phosphor layer 25 and into anode 23 causing an electromagnetic emission such as, for example, light. Anode 23, located directly behind the phosphor layer, facilitates the efficient extraction of excess electrons therefrom.

As shown in FIG. 6, and discussed hereinabove, the final FED structure may include sacrificial insulating layer 27 within it. Alternatively, as shown in FIG. 7 a portion of the sacrificial insulating layer disposed between the emitter and the phosphor may be removed to create minimum gap 29. Removal of the portion of the sacrificial insulating layer is performed by using, for example, reactive ion processing or a wet etch.

In either embodiment, with or without a portion of the sacrificial insulating layer removed, the thickness of sacrificial insulating layer 27 is kept to no more than the mean free path distance of an electron in air. The thickness of the sacrificial insulating layer corresponds to the distance between the emitter and the phosphor layer. Thus, in the embodiment of FIG. 7, minimum gap 29 becomes a virtual vacuum because there is a reduced likelihood of an electron encountering an air molecule as it passes from emitter to anode. A FED may therefore be created in which an evacuated, or inert gas environment is unnecessary.

Figure 8:
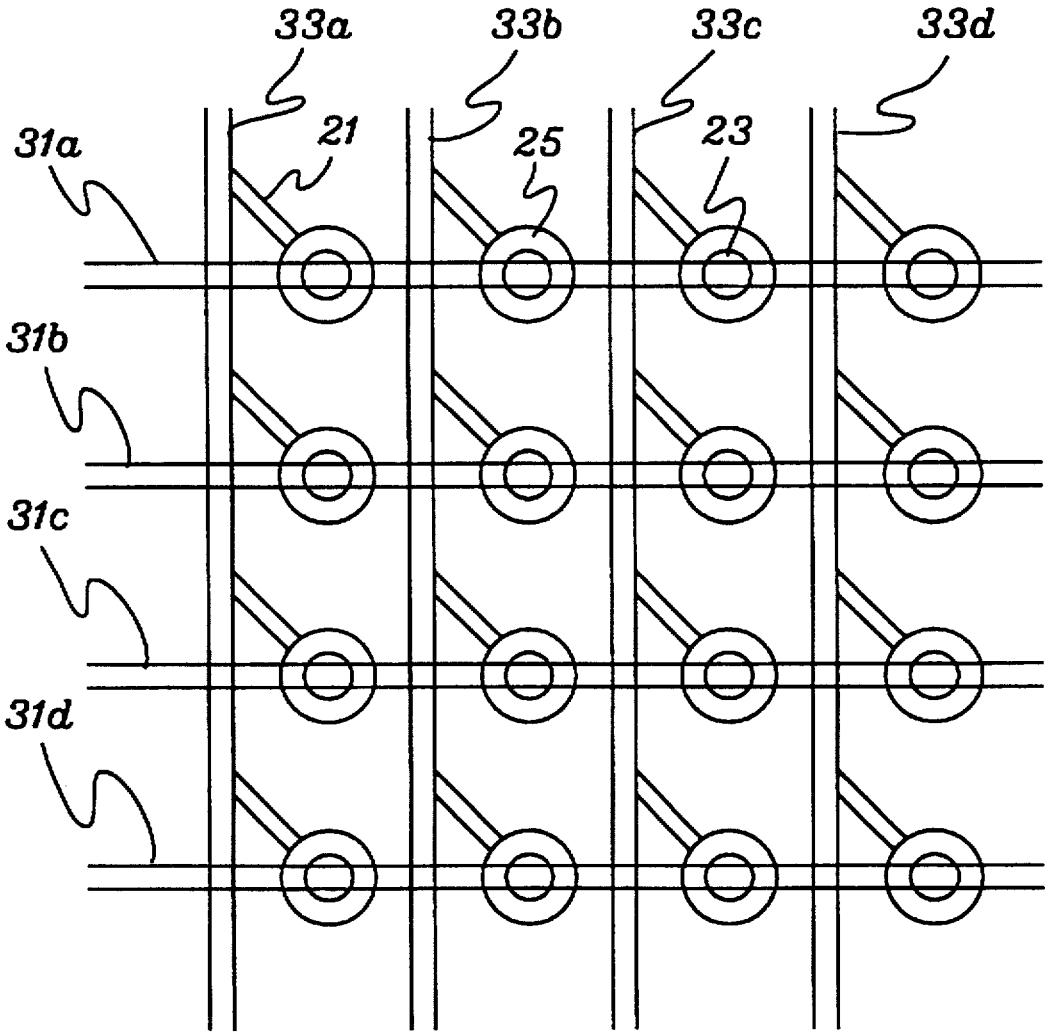
FIG. 8 is a top schematic view of one embodiment of a display according to the present invention which uses the light emitting FEDs of the present invention.

An electronic display may be created using the techniques for creating light emitting FEDs discussed hereinabove. The masking/deposition process steps of the present invention may be adapted to form a large number of light emitting FED devices on a common substrate. For example, the mask sections corresponding to individual FED elements may be replicated across a mask associated with an entire substrate or chip. In one embodiment, the fabrication processes are designed to form a display matrix in which the FEDs are organized as a series of rows and columns (FIG. 8). Each FED within the display represents one point of light, or pixel within the display matrix. As an example, FIG. 8 shows a group of pixels organized into an X×Y matrix, specifically a 4×4 matrix. It should be noted that other organizations of pixels (i.e., display matrices) which are not bounded by a pure row and column arrangement are possible.

The top schematic view of FIG. 8 shows one example of an organization and interconnection of the FEDs of the display. In particular, "cylindrical" anode 23 is shown having phosphor layer 25 disposed adjacent thereto. As previously discussed, emitter 21 directly contacts the phosphor layer (i.e., the "direct injection" embodiment of FIG. 5). Alternatively, emitter 21 could be spaced from the phosphor layer using the minimum gap techniques discussed hereinabove. Further, the emitter could be wider than the etched anode/phosphor hole such that the emitter "tip" circumscribes the hole.

Addressing for the display may be provided by row address lines 31*a–d* and column address lines 33*a– d*. Each row address line attaches to each anode 23 of each FED within a row of FEDs, while each column address line attaches to each emitter of each FED of a column of FEDs. Operationally, when an emission from a particular FED is desired, a voltage potential is applied between the emitter and anode of the particular FED by applying a voltage potential between the FED's associated row address line and column address line. Methods for controlling the display via the address lines will be apparent to one skilled in the art and are not discussed further herein.

The present invention comprises the formation of an advanced FED capable of emitting electromagnetic energy. Due to the extreme closeness, or even direct contact, of the emitter to the phosphor layer in an FED in accordance with the present invention, operating voltages are substantially lower than in previous devices. Moreover, the provisioning of a large anode behind the phosphor layer facilitates improved extraction of electrons therefrom. The anode's position behind the phosphor layer, perpendicular to the emitter, also eliminates ballistic steering problems. Furthermore, techniques described herein allow the creation of a FED capable of operation in ambient air environments. All of these features and advantages translate into an advanced FED, and associated display, capable of emitting electromagnetic energy.

While the invention has been described in detail herein, in accordance with certain preferred embodiments thereof, many modifications and changes therein may be affected by those skilled in the art. Accordingly, it is intended by the appended claims to cover all such modifications and changes as fall within the true spirit and scope of the invention.

We claim:

1. A method for forming a field emission device ("FED"), said FED being capable of emitting electromagnetic energy, said method comprising the steps of:

(a) providing a substrate having a main surface;

(b) forming an emitter above said main surface of said substrate, said emitter having a tip;

(c) forming a phosphor layer in spaced opposing relation to said tip of said emitter such that said tip of said emitter points towards, and is spaced a distance less than a mean free path distance of an electron in air away from, said phosphor layer; and (d) forming an anode above said main surface of said substrate, said anode including a first surface oriented substantially perpendicular to said main surface of said substrate, said first surface having said phosphor layer adjacent thereto such that said phosphor layer is disposed between said tip of said emitter and said first surface of said anode, wherein a voltage potential applied between said anode and said emitter causes electrons to be emitted from said tip of said emitter into said phosphor layer causing said phosphor layer to emit electromagnetic energy.

2. The method of claim 1, wherein said emitter forming step (b) comprises forming said emitter as a lateral emitter, said lateral emitter being substantially parallel to said main surface of said substrate.

3. The method of claim 1, wherein said anode forming step (d) comprises forming a cylindrical shaped anode such that said first surface of said anode has a circular cross-section and such that said phosphor layer adjacent to said first surface of said anode surrounds said anode.

4. The method of claim 1, wherein said phosphor layer forming step (c) comprises forming said phosphor layer as a zinc oxide ("ZnO") layer.

5. The method of claim 1, wherein said emitter forming step (b) comprises forming said emitter as a thin-film layer composed of n-type doped diamond.

6. A method for forming a field emission device ("FED"), said FED being capable of emitting electromagnetic energy, said method comprising the steps of:

(a) providing a substrate having a main surface:

(b) forming an emitter above said main surface of said substrate, said emitter having a tip:

(c) forming a phosphor layer in spaced opposing relation to said tip of said emitter such that said tip of said emitter points towards, and is spaced a distance less than a mean free path distance of an electron in air away from said phosphor layer:

(d) forming an anode above said main surface of said substrate, said anode including a first surface, said first surface having said phosphor layer adjacent thereto such that said phosphor layer is disposed between said tip of said emitter and said first surface of said anode, wherein a voltage potential applied between said anode and said emitter causes electrons to be emitted from said tip of said emitter into said phosphor layer causing said phosphor layer to emit electromagnetic energy: and (e) further including forming an insulating layer between and physically contacting said tip of the emitter and said phosphor layer, wherein a voltage potential applied between said anode and said emitter causes electrons to pass through said insulating layer into said phosphor layer.

7. A method for producing electromagnetic energy using a field emission device ("FED") comprising the steps of:

(a) providing a FED comprising: a substrate having a main surface; an anode disposed above said main surface of said substrate, said anode having a first surface disposed substantially perpendicular to the main surface of the substrate; a phosphor layer disposed adjacent to said first surface of said anode; and an emitter in spaced opposing relation to said first surface of said anode such that said emitter has a tip pointing towards, and spaced a distance less than a mean free path distance of an electron in air away from, said phosphor layer, wherein a voltage potential applied between said anode and said emitter causes electrons to be emitted from said tip of said emitter into said phosphor layer causing said phosphor layer to emit electromagnetic energy; and (b) applying a voltage potential between said anode and said emitter such that said phosphor layer emits electromagnetic energy.

8. The method of claim 7, wherein said FED providing step (a) comprises providing said phosphor layer as an insulating-type phosphor layer such that the tip of the emitter physically contacts said insulating-type phosphor layer such that during said voltage applying step (b), electrons are directly injected into said insulating-type phosphor layer.

9. The method of claim 7, wherein said FED providing step (a) comprises providing said phosphor layer such that said voltage applying step (b) causes said phosphor layer to emit visible light.

10. A method of forming a display comprising the step of forming a plurality of FEDs into a display matrix, each FED of said plurality of FEDs being formed according to the steps of:

(a) providing a substrate having a main surface;

(b) forming an emitter above said main surface of said substrate, said emitter having a tip;

(c) forming a phosphor layer in spaced opposing relation to said tip of said emitter such that said tip of said emitter points towards, and is spaced a distance less than a mean free path distance of an electron in air away from, said phosphor layer; and (d) forming an anode above said main surface of said substrate, said anode including a first surface oriented substantially perpendicular to the main surface of the substrate, said first surface having said phosphor layer disposed thereon such that said phosphor layer is disposed between said first surface of said anode and said tip of said emitter, and wherein a voltage potential applied between said anode and said emitter causes electrons to be emitted from said tip of said emitter into said phosphor layer causing said phosphor layer to emit electromagnetic energy.

11. The method of claim 10, wherein said emitter forming step (b) of each FED of said plurality of FEDs comprises forming said emitter as a lateral emitter, said lateral emitter being substantially parallel to said main surface of said substrate.

* * * * *